United States Patent [19]

Nelson

[11] 4,040,488

[45] Aug. 9, 1977

[54] DIFFERENTIAL VALVE

[75] Inventor: Wayne F. Nelson, Wichita Falls, Tex.

[73] Assignee: The Dow Chemical Company, Midland, Mich.

[21] Appl. No.: 727,074

[22] Filed: Sept. 27, 1976

[51] Int. Cl.[2] ..... E21B 43/00

[52] U.S. Cl. ..... 166/317; 166/327; 137/515

[58] Field of Search ..... 166/317, 325; 137/515, 137/515.3, 515.5, 515.7

[56] References Cited

U.S. PATENT DOCUMENTS

| | | | |
|---|---|---|---|
| 2,812,821 | 11/1957 | Nelson | 166/325 |
| 2,841,171 | 7/1958 | Baker et al. | 166/325 |
| 2,931,439 | 4/1960 | Alexander | 166/325 |
| 3,011,559 | 12/1961 | Muse et al. | 166/325 |
| 3,220,481 | 11/1965 | Park | 166/325 |
| 3,376,935 | 4/1968 | Baker | 166/325 |

*Primary Examiner*—James A. Leppink
*Attorney, Agent, or Firm*—M. B. Lilly; Earl D. Ayers

[57] ABSTRACT

The invention is a differential fill valve apparatus principally for use in treating earth wells, usually in connection with cementing a string of casing into the well bore. The apparatus, at or near the low end of the casing, has a pressure actuated slidable piston which rises as liquid is encountered in the well bore opening parts for admitting liquid into the casing until the pressure from liquid in the casing reaches a predetermined ratio with respect to the pressure in the well bore annulus.

Means are provided for locking the piston in its closed position after the casing string is in place in the well, permitting the use of the apparatus as conventional cementing valve apparatus.

6 Claims, 5 Drawing Figures

DIFFERENTIAL VALVE

BACKGROUND OF THE INVENTION

This invention relates to cementing valve apparatus and particularly to differential fill valve apparatus for use in earth wells and the like.

When a string of casing is to be run into an earth well, the casing may be open ended at the bottom whereby the drilling mud or other pumpable material in the well simply fills the casing as the string is lowered into it.

On the other hand, the bottom part of the casing string may be closed, keeping the casing somewhat buoyant as the string is lowered through pumpable material.

When the bottom part of the casing is closed, the resulting buoyancy relieves some of the strain on the drilling rig, but sometimes too much buoyancy occurs.

OBJECT OF THE INVENTION

Accordingly, a principal object of this invention is to provide an improved differential valve for use in well casing operations including cementing the casing in place in the well bore.

Another object of this invention is to provide an improved differential valve for use in well casing operations which positively acts as a conventional cementing valve to prevent the back-flow of cement from the well bore annulus into the casing.

A further object of this invention is to provide a relatively simple, easy to assemble improved differential fill valve for use in well casing operations.

STATEMENT OF INVENTION

In accordance with this invention, there is provided differential valve apparatus comprising a tubular housing adapted to be coupled to a string of tubing. The housing contains a flapper valve assembly supported across the housing and including flow parts adjacent to the flapper valve.

A movable piston responding to pressure differentials within the housing bears against and closes the flow parts until raised on application of a predetermined pressure from below. The piston closes on the parts when the pressure above the piston reaches a predetermined fraction of the pressure below the parts.

When the casing is in position in the well bore and cementing is to take place, ball means dropped into the apparatus seals the upper pressure releasable section of the apparatus. Addition of a predetermined pressure moves the upper section down and locks the piston in its flow blocking position against the flow parts to prevent back flow of cement. The flapper valve then functions as a conventional cementing check valve.

BRIEF DESCRIPTION OF THE DRAWING

The invention, as well as additional objects and advantages thereof, will best be understood when the following detailed description is read in connection with the accompanying drawing, in which.

DETAILED DESCRIPTION OF THE DRAWINGS

Figure 1:
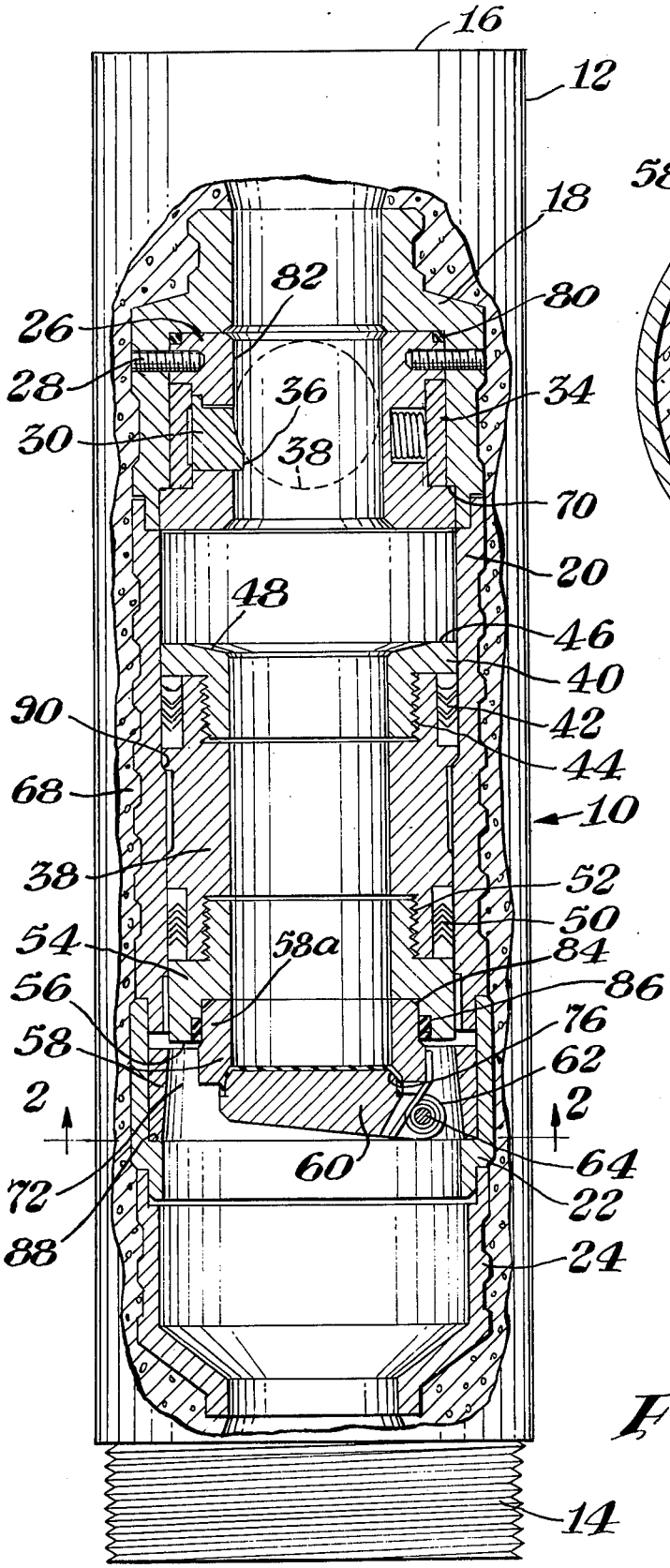
FIG. 1 is an elevational view, partly broken away and in section, of apparatus in accordance with this invention.
Figure 2:
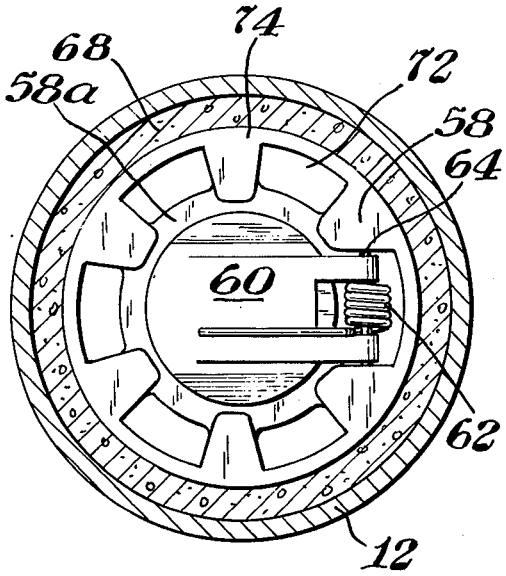
FIG. 2 is a sectional view taken along the line 2—2 of FIG. 1.

Referring to the drawings, and particularly to FIGS. 1 and 2, there is shown apparatus, indicated generally by the numeral 10, having a tubular outer housing 12 including an upper end 16 and a lower end 14 adapted to be coupled, usually, to a string of casing and a cementing shoe or the like, respectively.

A four piece casing (18, 20, 22, 24) is held in position within the housing 12 by cement 68. The various edges of the casing telescope with the adjacent casing part and are bonded together, by an epoxy material, for example.

A dog retainer sleeve 26 fits within the casing member 18 and is sealed with respect thereto at its upper end by seal 80.

The dog retainer 26 is held in position by shear pins 28.

An array of dogs 30 (two of them) extend through ports in the dog retainer and into the central bore 82 by the snap ring 34.

An array of coil springs 32 (four of them) are disposed in recesses in the outer wall of the dog retainer and urge the snap ring 34 in an outward direction.

The lower end of the dog retainer 26 has a flanged part which abuts against a shoulder 70 near the lower end of the casing member 18.

A slidable piston comprising a center part 38, upper part 40 and lower part 54 is disposed along the inner wall of the casing below and spaced from the dog retainer 26. The top of the upper part 40 has a flat outer surface 46 and an inner inwardly tapered part 48.

Seals 42 and 50, at the upper and lower ends of the center part 38, provide a sealing relationship between the movable piston and the inner tubular wall of the casing.

The parts 40 and 54 are secured to the center part 38 by threaded connections 44, 52, respectively. This assembly means permits the packing 42, 50 to be fitted over the end parts of the center part 38 and held securely in place.

The lower part 54 of the piston has an axially disposed counterbored part 84 which has a seal 86 around the inner periphery of its lower end.

The upwardly extending end part **58*a* of a combination flow part and flapper valve assembly 58 fits into and may seal with the counterbored part 84.**

The flapper valve assembly 58, referring now to FIG. 2 as well as FIG. 1, has a cylindrical outer wall part which fits closely against the inner wall of the part 22, being retained in the part 22 by the shoulder 88.

The part **58*a* is generally tubular in configuration and has a valve seat at its lower end to accommodate the flapper valve 60. The part 58*a* is joined to the outer part of the assembly 58 over the lower part of its length by inwardly extending upper wall elements 74 through which flow ports 72** extend.

The flapper valve 60 is hinged from pin 64 which is coupled between two of the inwardly extending elements 74 and urged to its closed position by the spring 62. A resilient seal area 76 is disposed on the upper seating surface of the valve 60.

Operation

As the apparatus, attached to a string of casing, is lowered into a well containing liquid or a slurry, pressure against the lower end 56 of the piston will force the piston upwardly (See FIG. 3), clearing the part 58*a*. Well bore flowable material then may pass upwardly through the ports 72 and the interior of the apparatus.

When the pressure above the apparatus reaches a predetermined amount, pressure on the upper end surfaces 46, 48, of the piston (whose area is larger than that of the end surface 56) will close the piston. The piston thus may open and close several times as the apparatus is lowered through liquid or slurry in the well bore.

Figure 3:
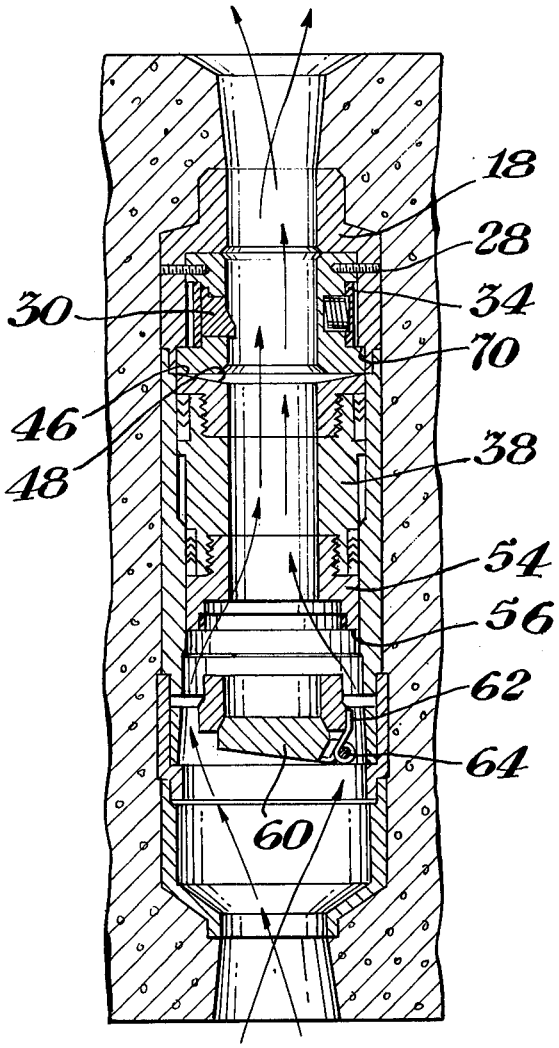
FIG. 3 is a fragmentary elevational view showing the movable piston in the upper position.
Figure 4:
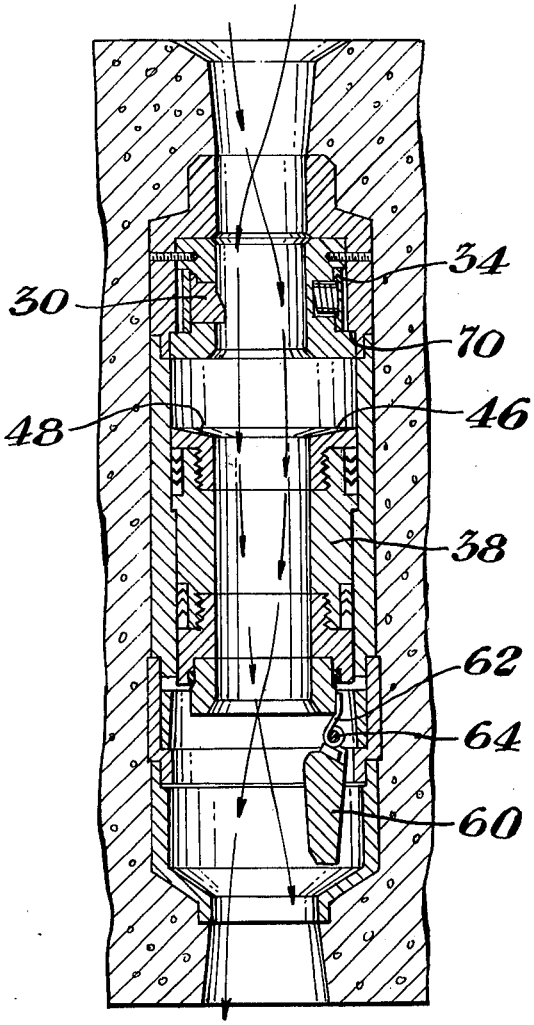
FIG. 4 is a fragmentary elevational view showing the apparatus in the circulating position.

If it is desired to circulate liquid through the casing as the casing is lowered in the well, the piston drops over the part 58*a* and the pressure then opens the valve 60 to flow material through the apparatus, as shown in FIG. 3.

When the casing is in position in the well bore, it is usually desirable to have the apparatus function only as a conventional cement retaining valve unit.

Figure 5:
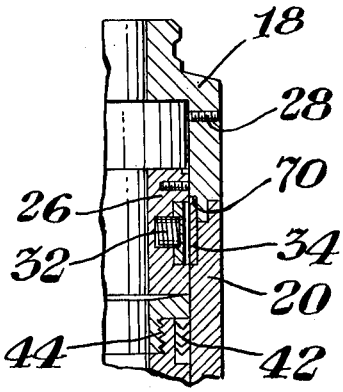
FIG. 5 is a fragmentary view showing the movable piston in its locked down position.

A ball 38, adapted to fit closely in the bore 82, is dropped down the casing and is retained in the apparatus by the dogs 30. Application of additional pressure causes the shear pins to break. The dog retainer 26 is then forced downwardly, as shown in FIG. 5, coming to rest against the top part 40 of the piston. This allows the snap rings 34 to expand and seat under the shoulder 70, holding the piston in the "closed" position with respect to the part 58*a*.

The expansion of the snap rings 34 also allows the dogs 30 to retract, permitting the ball 38 to pass on through the apparatus.

The apparatus thereafter functions as conventional cementing valve apparatus.

If two or more differential valves are used along the casing, a single ball 38 may be used to actuate each valve device.

The shoulder 90 restricts downward movement of the piston, preventing excessive movement over part 58*a*.

The advantages of differential valve equipment in accordance with this invention are: protection against high pressure surges or "ram effect" that can fracture weak formations and cause lost circulation and primary cementing problems; means of circulating without losing the automatic fill-up feature; reduced rig time by the elimination of surface filling operations; faster running time, thus less changes of sticking the casing; drillable high strength valve securely anchored in the shoe or collar with drillable high strength cement, and means of converting to conventional type floating equipment at any time while running in.

Except for the seals and cement, the inner parts of the apparatus are made of an aluminum alloy.

What is claimed is:

1. Differential valve apparatus comprising within an elongated multisection inner casing having upper and lower ends, a dog retainer section, a piston section and a check valve and flow port section;

said casing having an axial bore extending therethrough, said bore having a larger diameter section intermediate of its ends, said dog retainer section having an axial bore extending therethrough and fitting slidably within the upper part of said bore in said casing with an outwardly flanged part at its lower end which is being disposed in the larger diameter section of said casing bore, but is held in fixed position by shearable means, said dog retainer section having a retractable ball retaining means extending through its side walls and retained in place by circumferentially expandable detent means, said piston section having an axial bore extending therethrough, an upper end and a lower end, the upper end part of said piston section being of larger diameter than the remainder thereof, said upper end of said piston section being disposed in the larger diameter part of said casing bore, a pair of spaced apart seals, each seal extending around said piston section, said lower end of said piston section which is subject to pressure from below having an area less than the upper end of said section and having a wall seal containing counterbored part for sealing with a tubular walled part of said check valve and flow port section, said check valve and flow part section comprising a tubular outer part and a tubular walled inner part joined by wall sections surrounding axially disposed flow ports, said tubular walled inner part having a valve seat and check valve at its lower end, said check valve and flow port section being disposed for limited sliding movement within said casing.

2. Apparatus in accordance with claim 1, wherein said shearable means are shear screws.

3. Apparatus in accordance with claim 2, wherein said circumferentially expandable detent means are snap rings which are spring loaded from said dog retainer section.

4. Apparatus in accordance with claim 1, wherein said check valve is a spring loaded flapper valve.

5. Apparatus in accordance with claim 1, wherein said seal in the lower end of said piston section is a V type seal.

6. Apparatus in accordance with claim 1, wherein the space between the top of said piston section when said piston is in its most downward position and the top of said enlarged diameter section of said axial bore in said casing is equal to or slightly greater than the distance from the bottom of said dog retainer section and the top of said expandable detent means.

* * * * *

UNITED STATES PATENT AND TRADEMARK OFFICE

CERTIFICATE OF CORRECTION

PATENT NO. : 4,040,488
DATED : August 9, 1977
INVENTOR(S) : Wayne F. Nelson

It is certified that error appears in the above-identified patent and that said Letters Patent are hereby corrected as shown below:

In column 3, line 50, delete "changes" and insert --chances--.

In column 4, Claim 5, line 47, add brackets on each side of V, i.e. "V".

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*